US006859949B1

(12) United States Patent
Gavin

(10) Patent No.: US 6,859,949 B1
(45) Date of Patent: Mar. 1, 2005

(54) TOILET PLUNGER APPARATUS

(76) Inventor: Lawrence E. Gavin, 1672 Maple Creek Ct., Rochester, MI (US) 48306

( * ) Notice: Subject to any disclaimer, the term of this patent is extended or adjusted under 35 U.S.C. 154(b) by 0 days.

(21) Appl. No.: 10/639,870

(22) Filed: Aug. 13, 2003

(51) Int. Cl.[7] ..... E03D 9/00
(52) U.S. Cl. ..... 4/255.11; 4/255.05
(58) Field of Search ..... 4/255.01–255.11

(56) References Cited

U.S. PATENT DOCUMENTS 1,476,969 A 12/1923 Howard
2,844,826 A 7/1958 Cheiten
3,608,098 A * 9/1971 Andrisani ..... 4/255.04
5,384,918 A 1/1995 Leighton et al.
5,403,166 A * 4/1995 Pingiotti ..... 417/437
5,537,694 A * 7/1996 Davenport ..... 4/255.05
6,216,283 B1 * 4/2001 Tash ..... 4/255.11
6,510,860 B2 1/2003 Kihs

* cited by examiner

*Primary Examiner*—Charles E. Phillips

(57) ABSTRACT

A toilet plunger apparatus includes a handle and an air compression/expansion bellows portion connected to the handle. The bellows portion includes a distal end. A substantially rigid offset-angle adapter is connected to the bellows distal end. The offset-angle adapter includes a first adapter arm portion having a first arm outer diameter and a second adapter arm portion having a second arm outer diameter. The second adapter arm portion includes an open distal arm portion end. The second arm outer diameter is less than the first arm outer diameter, and the second adapter arm portion is oriented with respect to the first adapter arm portion at an arm-to-arm offset angle which is preferably, approximately 135 angular degrees. An adapter kit having an offset-angle adapter in accordance with the invention can be provided for retrofitting a conventional bellows-type toilet plunger.

10 Claims, 3 Drawing Sheets

FIG 3
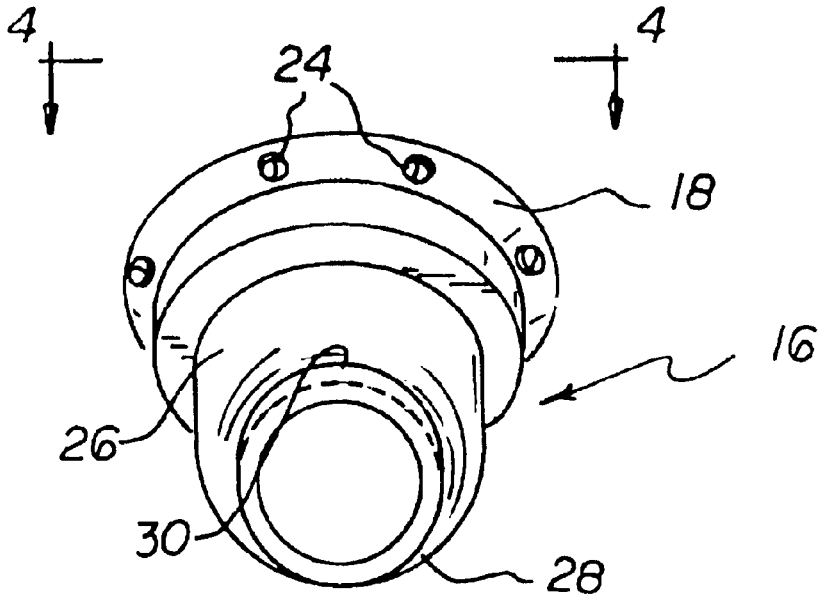
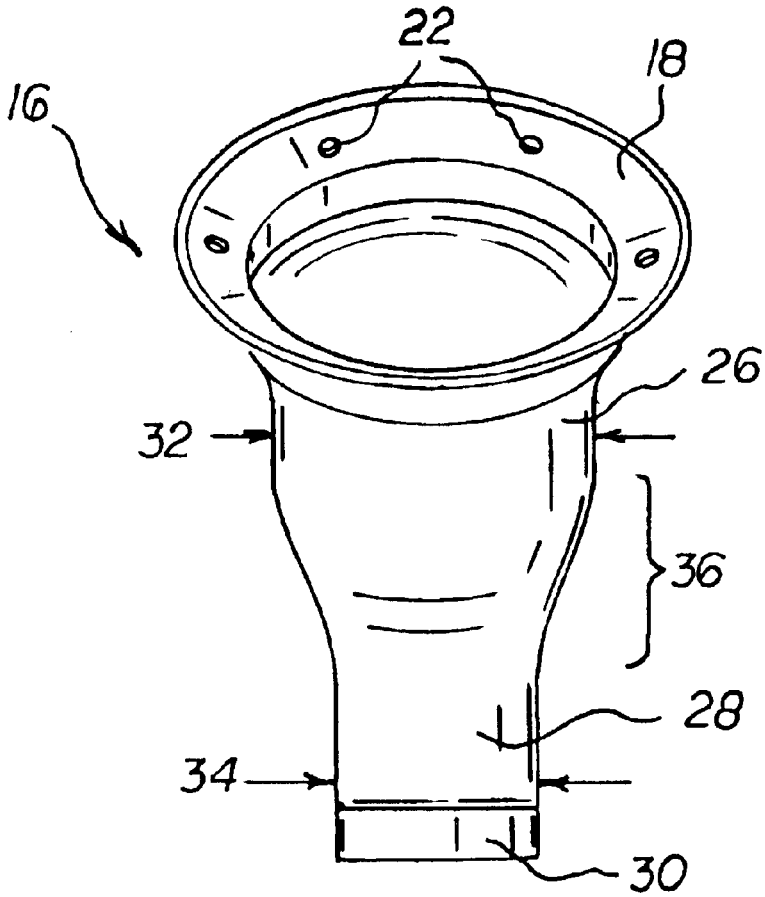
FIG 4

TOILET PLUNGER APPARATUS

BACKGROUND OF THE INVENTION

1. Field of the Invention

The present invention relates generally to toilet plungers and, more particularly, to toilet plungers especially adapted for use in modem toilets.

2. Description of the Prior Art

Conventional toilet plungers are ineffective when used to unplug the Federally mandated 1.6 gallon toilets since virtually all toilets now constructed have a trough at the bottom of the toilet bowl. In order to minimize the amount of water necessary to cover the toilet discharge outlet, a trough is molded into the commode bowl. Most discharge outlets are also changed from an angle of about 45 degrees to a near vertical configuration. Previously, a conventional toilet plunger could be tipped to an angle nearly matching the discharge outlet, and the total force exerted by the operator on the plunger would be directed into the discharge outlet, for dislodging any clog, with several rapid cycles of compression and expansion.

Since the above-mentioned modern toilets are designed with the trough and a vertical discharge outlet, the conventional toilet plungers cannot be angled to match the vertical outlet and cannot fit down into the narrow trough. As a result, with a conventional plunger being used with such a modern toilet, the force exerted by the operator on the plunger is dissipated equally in all directions due to the aiming of the force at the trough bottom. Therefore, only a small portion of the operator-exerted force is able to enter the discharge outlet for dislodging an obstruction. As a result, many obstructions are not dislodged by such a reduced dislodging force.

U.S. Pat. No. 6,216,283 provides an elephant nose plunger in which a flexible, small diameter bellows section is located at the end of a flexible large diameter bellows section. However, such a toilet plunger cannot overcome the modem trough design. Use of the elephant nose plunger would require much manipulation on the part of the operator to position the small diameter bellows section into the discharge outlet at the end of every compression/expansion cycle. Also, the small diameter bellows section cannot seal the trough from blowback since the trough bottom is normally flush with the discharge outlet. In view of the above, it would be desirable if a toilet plunger apparatus were provided which allows the distal end of the plunger to nestle in the trough and fit inside the discharge outlet of modem toilets. Moreover, it would be desirable if a toilet plunger apparatus included a sealing lip to engage the edge of the discharge outlet and to lock the plunger in place during compression/expansion cycles.

As stated above, conventional toilet plungers, especially conventional plungers which include a bellows for exerting the compression/expansion cycles, are not adapted for the modem toilets. In this respect, it would be desirable if a toilet plunger apparatus were provided for retrofitting a conventional toilet plunger to operate with modern toilets. More specifically, it would be desirable if a kit were provided for converting a conventional bellows plunger to one that is suitable for use with modern toilets.

Aside from the U.S. patent discussed above, the following U.S. patents may also be of interest: U.S. Pat. Nos. 1,476,969, 2,844,826, 5,384,918, and 6,510,860. More specifically, U.S. Pat. No. 1,476,969 discloses a sewer cleaner. U.S. Pat. No. 2,844,826 discloses a conventional bellows plunger. U.S. Pat. No. 5,384,918 discloses a plunger connected to a source of extraneous water pressure. U.S. Pat. No. 6,510,860 discloses an adapter for a drain clearing tool.

Thus, while the foregoing body of prior art indicates it to be well known to use a toilet plunger that has a relatively small diameter distal end, the prior art described above does not teach or suggest a toilet plunger apparatus which has the following combination of desirable features: (1) allows the distal end of the plunger to nestle in the trough and fit inside the discharge outlet of modern toilets; (2) includes a sealing lip to engage the edge of the discharge outlet and to lock the plunger in place during compression/expansion cycles; (3) provides for retrofitting a conventional bellows toilet plunger to operate with modem toilets; and (4) provides a kit for converting a conventional bellows plunger to one that is suitable for use with modern toilets. The foregoing desired characteristics are provided by the unique toilet plunger apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a toilet plunger apparatus which includes a handle and an air compression/expansion portion connected to the handle. The air compression/expansion portion includes a compressor/expander distal end. A substantially rigid offset-angle adapter is connected to the compressor/expander distal end. The offset-angle adapter includes a first adapter arm portion having a first arm outer diameter, a second adapter arm portion having a second arm outer diameter, and an arm-to-arm transition region located between the first adapter arm portion and the second adapter arm portion. The second adapter arm portion includes an open distal arm portion end. The second arm outer diameter is less than the first arm outer diameter, and the second adapter arm portion is oriented with respect to the first adapter arm portion at an arm-to-arm offset angle. Preferably, the arm-to-arm offset angle is approximately 135 angular degrees. Preferably, the air compression/expansion portion is in a form of a bellows.

Preferably, the offset-angle adapter includes a first fastener receiver flange, and fasteners are employed for securing the first fastener receiver flange to the compressor/expander distal end. Preferably, the compressor/expander distal end is convex shaped, and the first fastener receiver flange is concave shaped. A first sealing ring is positioned between the compressor/expander distal end and the first fastener receiver flange. A second sealing ring is positioned between the compressor/expander distal end and the offset-angle adapter. The first fastener receiver flange includes fastener-reception channels for receiving the fasteners. The second adapter arm portion includes a raised sealing lip.

An adapter kit having an offset-angle adapter in accordance with the invention can be provided for retrofitting a conventional bellows-type toilet plunger.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toilet plunger apparatus which has all of the advantages of the prior art and none of the disadvantages.

It is another object of the present invention to provide a new and improved toilet plunger apparatus which may be easily and efficiently manufactured and marketed.

It is a further object of the present invention to provide a new and improved toilet plunger apparatus which is of durable and reliable construction.

An even further object of the present invention is to provide a new and improved toilet plunger apparatus which is susceptible of a low cost of manufacture with regard to both materials and labor, and which accordingly is then susceptible of low prices of sale to the consuming public, thereby making such toilet plunger apparatus available to the buying public.

Still yet a further object of the present invention is to provide a new and improved toilet plunger apparatus which allows the distal end of the plunger to nestle in the trough and fit inside the discharge outlet of modem toilets.

Still another object of the present invention is to provide a new and improved toilet plunger apparatus that includes a sealing lip to engage the edge of the discharge outlet and to lock the plunger in place during compression/expansion cycles.

Yet another object of the present invention is to provide a new and improved toilet plunger apparatus which provides for retrofitting a conventional bellows toilet plunger to operate with modem toilets.

Even another object of the present invention is to provide a new and improved toilet plunger apparatus that provides a kit for converting a conventional bellows plunger to one that is suitable for use with modem toilets.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is an end view of the embodiment of the toilet plunger apparatus of FIG. 2 taken along line 3—3 thereof.

FIG. 4 is top view of the embodiment of the toilet plunger apparatus of FIG. 3 taken along line 4—4 thereof.

DESCRIPTION OF THE PREFERRED EMBODIMENT

Figure 1:
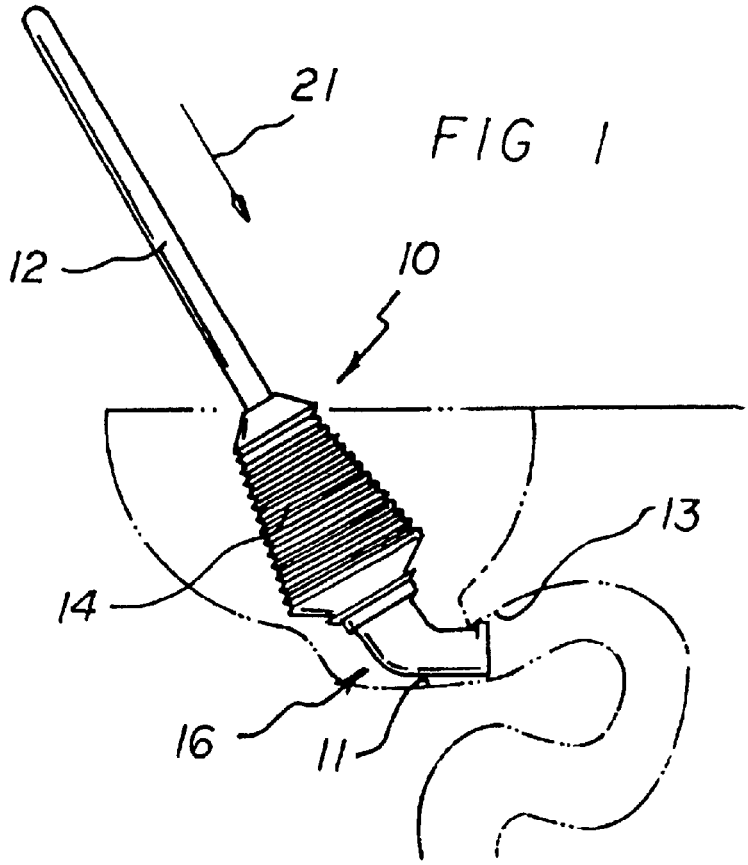
FIG. 1 is a side view showing a preferred embodiment of the toilet plunger apparatus of the invention in use with a modern toilet so that the distal end of the plunger is nestled in the trough and fits inside the discharge outlet of the toilet.
Figure 2:
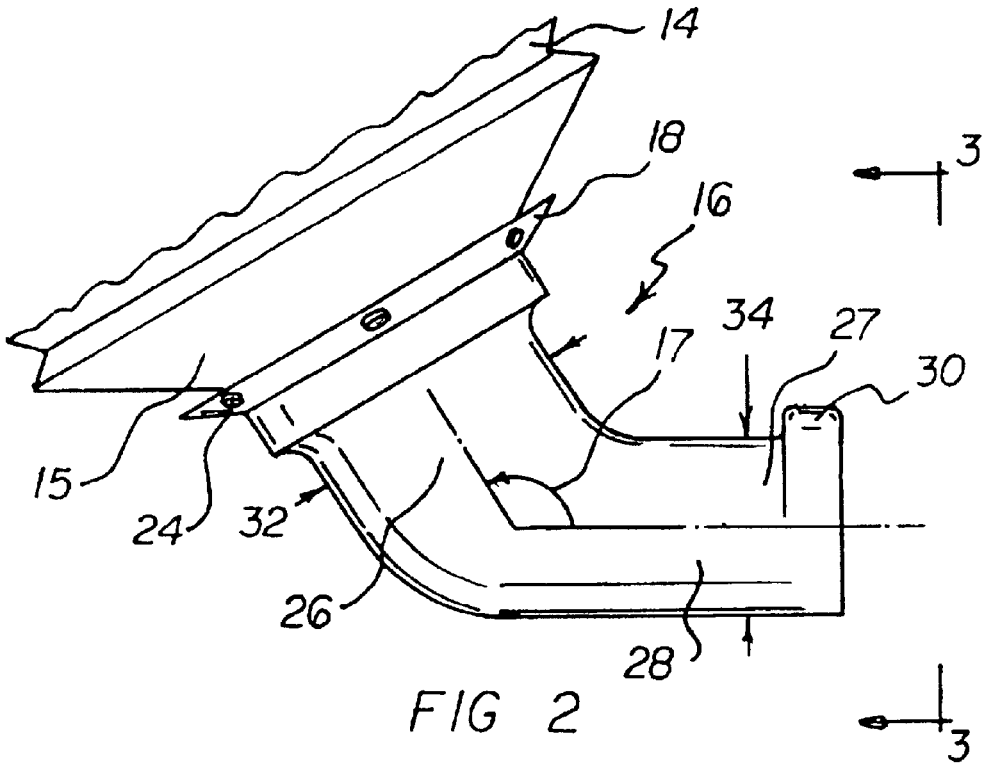
FIG. 2 is an enlarged partial side view of the offset-angle adapter portion of the invention shown in FIG. 1 and its connection with the bellows of the plunger.
Figure 5:
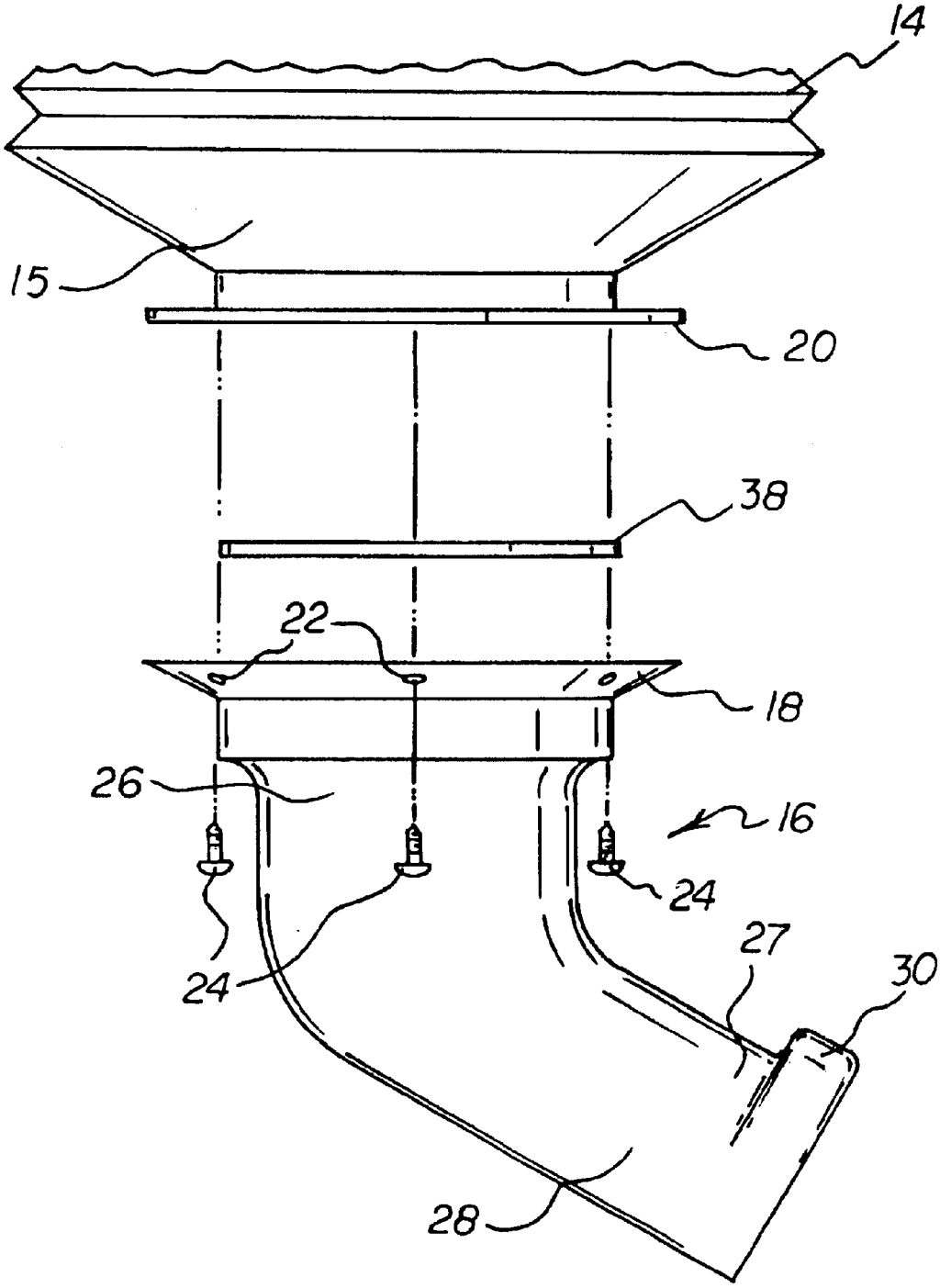
FIG. 5 is an exploded side view of the embodiment of the invention shown in FIGS. 1–4.

With reference to the drawings, a new and improved toilet plunger apparatus embodying the principles and concepts of the present invention will be described.

Turning to FIGS. 1–5, there is shown a preferred embodiment of the toilet plunger apparatus of the invention generally designated by reference numeral 10. In the first embodiment, toilet plunger apparatus 10 includes a handle 12 and an air compression/expansion portion 14 connected to the handle 12. The air compression/expansion portion 14 includes a compressor/expander distal end 15. A substantially rigid offset-angle adapter 16 is connected to the compressor/expander distal end 15. The offset-angle adapter 16 includes a first adapter arm portion 26 having a first arm outer diameter 32, a second adapter arm portion 28 having a second arm outer diameter 34, and an arm-to-arm transition region 36 located between the first adapter arm portion 26 and the second adapter arm portion 28. The second adapter arm portion 28 includes an open distal arm portion end 27. The second arm outer diameter 34 is less than the first arm outer diameter 32, and the second adapter arm portion 28 is oriented with respect to the first adapter arm portion 26 at an arm-to-arm offset angle 17. Preferably, the arm-to-arm offset angle 17 is approximately 135 angular degrees. Preferably, the air compression/expansion portion 14 is in a form of a bellows 14.

Preferably, the offset-angle adapter 16 includes a first fastener receiver flange 18, and fasteners 24 are employed for securing the first fastener receiver flange 18 to the compressor/expander distal end 15. Preferably, the compressor/expander distal end 15 is convex shaped, and the first fastener receiver flange 18 is concave shaped. A first sealing ring 20 is positioned between the compressor/expander distal end 15 and the first fastener receiver flange 18. A second sealing ring 38 is positioned between the compressor/expander distal end 15 and the offset-angle adapter 16. The first fastener receiver flange 18 includes fastener-reception channels 22 for receiving the fasteners 24. The second adapter arm portion 28 includes a raised sealing lip 30.

To install an offset-angle adapter 16 of the invention on a conventional bellows-containing toilet plunger, as shown in FIG. 1, the first sealing ring 20 and the second sealing ring 38 are placed in registration with the first fastener receiver flange 18. The fasteners 24 are placed in the fastener-reception channels 22, and the fasteners 24 are screwed into the compressor/expander distal end 15 of the bellows 14.

The sealing rings provide an air-tight seal so that when air is compressed in the bellows 14, the compressed air does not leak out past the connection between the first fastener receiver flange 18 and the compressor/expander distal end 15.

As shown in FIG. 1, when the offset-angle adapter 16 is installed on the conventional bellows-containing toilet plunger, when the handle 12 is pushed in the direction indicated by compression direction arrow 21, the pressure from the compressed air is transmitted through the first adapter arm portion 26 and the second adapter arm portion 28 to the open distal arm portion end 27.

The second adapter arm portion 28 seats in the toilet trough 11, shown in FIG. 1, and the raised sealing lip 30 forms a seal with the toilet discharge outlet 13, also as shown in FIG. 1. The second adapter arm portion 28 can have a diameter of approximately 2.5 inches for fitting into the trough of the commode.

When the toilet plunger apparatus 10 of the invention is employed with several rapid cycles of compression and expansion, the second adapter arm portion 28 remains in the toilet trough 11, and the raised sealing lip 30 remains in sealing engagement with the toilet discharge outlet 13.

More specifically, to install the toilet plunger apparatus 10 of the invention into a toilet, the apparatus can be swiftly positioned by tipping it slightly forward to guide the open distal arm portion end 27 into the toilet discharge outlet 13. The toilet trough 11 will stabilize the toilet plunger apparatus 10 when in use. The handle 12 is then tipped back at a slight angle toward the operator, thereby making the apparatus easier to cycle the compression and expansion movement. Pressure on the handle 12 will force the second adapter arm portion 28 into the toilet discharge outlet 13 and will maintain its position. All of the force on the apparatus will flow directly into the toilet discharge outlet 13.

The following components of the invention can be packaged as an adapter kit for retrofitting a conventional bellows-containing toilet plunger in accordance with the principles of the invention: an offset-angle adapter 16; a plurality of fasteners 24; a first sealing ring 20; and a second sealing ring 38. The offset-angle adapter 16 includes a first adapter arm portion 26 having a first arm outer diameter 32 and includes a first fastener receiver flange 18 which includes fastener-reception channels 22. A second adapter arm portion 28 has a second arm outer diameter 34, and an arm-to-arm transition region 36 is located between the first adapter arm portion 26 and the second adapter arm portion 28. The second adapter arm portion 28 includes an open distal arm portion end 27. The second arm outer diameter 34 is less than the first arm outer diameter 32, and the second adapter arm portion 28 is oriented with respect to the first adapter arm portion 26 at an arm-to-arm offset angle 17.

The components of the toilet plunger apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved toilet plunger apparatus that is low in cost, relatively simple in design and operation, and which may advantageously be used to allow the distal end of the plunger to nestle in the trough and fit inside the discharge outlet of modem toilets. With the invention, a toilet plunger apparatus is provided which includes a sealing lip to engage the edge of the discharge outlet and to lock the plunger in place during compression/expansion cycles. With the invention, a toilet plunger apparatus provides for retrofitting a conventional bellows toilet plunger to operate with modern toilets. With the invention, a toilet plunger apparatus provides a kit for converting a conventional bellows plunger to one that is suitable for use with modern toilets.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application.

Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A toilet plunger apparatus, comprising:

a handle, an air compression/expansion portion connected to said handle, wherein said air compression/expansion portion includes a compressor/expander distal end, and a substantially rigid offset-angle adapter connected to said compressor/expander distal end, said offset-angle adapter includes a first fastener receiver flange, and fasteners are employable for securing said first fastener receiver flange to said compressor/expander distal end, wherein said offset-angle adapter includes a first adapter arm portion having a first arm outer diameter, a second adapter arm portion having a second arm outer diameter, and an arm-to-arm transition region located between said first adapter arm portion and said second adapter arm portion, wherein said second adapter arm portion includes an open distal arm portion end, wherein said second arm outer diameter is less than said first arm outer diameter, and wherein said second adapter arm portion is oriented with respect to said first adapter arm portion at an arm-to-arm offset angle.

2. The apparatus of claim 1 wherein said arm-to-arm offset angle is approximately 135 angular degrees.

3. The apparatus of claim 1 wherein said air compression/expansion portion is in a form of a bellows.

4. The apparatus of claim 1, further including a first adapter arm portion having a first arm outer diameter and a first fastener receiver flange which includes fastener-reception channels, a second adapter arm portion having a second arm outer diameter, and an arm-to-arm transition region located between said first adapter arm portion and said second adapter arm portion, wherein said second adapter arm portion includes an open distal arm portion end, wherein said second arm outer diameter is less than said first arm outer diameter, wherein said second adapter arm portion is oriented with respect to said first adapter arm portion at an arm-to-arm offset angle.

5. The apparatus of claim 1 wherein:

said compressor/expander distal end is convex shaped, and said first fastener receiver flange is concave shaped.

6. The apparatus of claim 1, further including:

a first sealing ring positioned between said compressor/expander distal end and said first fastener receiver flange.

7. The apparatus of claim 6, further including:

a second sealing ring positioned between said compressor/expander distal end and said offset-angle adapter.

8. The apparatus of claim 1 wherein said first fastener receiver flange includes fastener-reception channels for receiving said fasteners.

9. The apparatus of claim 1 wherein said second adapter arm portion includes a raised sealing lip.

10. An adapter kit for a bellows-containing toilet plunger, .comprising:

an offset-angle adapter described in claim 1, fasteners, and one or more sealing rings for positioning between a compressor/expander distal end of the toilet plunger and said first fastener receiver flange.

* * * * *